US006527237B2

(12) United States Patent
Harary et al.

(10) Patent No.: US 6,527,237 B2
(45) Date of Patent: Mar. 4, 2003

(54) CROSSBAR BRACKET ASSEMBLY FOR SPEAKERS AND MONITORS

(75) Inventors: Eli Harary, Huntington, NY (US); David Wathen, Los Angeles, CA (US); Etienne Iliffe-Moon, Los Angeles, CA (US); William P. Conley, Thousand Oaks, CA (US)

(73) Assignee: Harman International Industries Incorporated, Northridge, CA (US)

( * ) Notice: Subject to any disclaimer, the term of this patent is extended or adjusted under 35 U.S.C. 154(b) by 0 days.

(21) Appl. No.: 09/949,220

(22) Filed: Sep. 7, 2001

(65) Prior Publication Data

US 2003/0001055 A1 Jan. 2, 2003

Related U.S. Application Data

(60) Provisional application No. 60/302,830, filed on Jul. 2, 2001.

(51) Int. Cl.[7] ..... A47B 96/06

(52) U.S. Cl. ..... 248/221.11; 248/298.1; 248/222.52; 181/141

(58) Field of Search ..... 248/221.11, 298.1, 248/222.52, 224.7, 286.1, 316.8; 381/205, 87, 333, 386, 387, 388, 390, 395; 361/683; 181/141, 144, 143

(56) References Cited

U.S. PATENT DOCUMENTS

| | | | | |
|---|---|---|---|---|
| 3,976,162 A | | 8/1976 | Cummings | 181/141 |
| D250,262 S | * | 11/1978 | Phillips | D14/210 |
| 5,448,647 A | | 9/1995 | Cummings | 381/90 |
| D366,478 S | | 1/1996 | Daniels et al. | D14/114 |
| 5,583,743 A | | 12/1996 | Levins et al. | 361/683 |
| 5,701,347 A | | 12/1997 | Daniels et al. | 381/24 |
| 5,704,578 A | * | 1/1998 | Fischer | 248/221.11 |
| 5,833,186 A | | 11/1998 | Kosmoski et al. | 248/221.11 |
| 5,896,461 A | | 4/1999 | Faraci et al. | 381/386 |
| 5,947,434 A | | 9/1999 | Kosmoski et al. | 248/298.1 |
| 5,970,161 A | | 10/1999 | Takashima et al. | 381/386 |
| 6,015,132 A | * | 1/2000 | Belle | 248/205.3 |
| 6,100,942 A | | 8/2000 | Hollenbaugh et al. | 348/836 |
| 6,149,114 A | | 11/2000 | Epping et al. | 248/220.22 |
| D451,085 S | * | 11/2001 | Masui | D14/211 |
| 6,311,946 B1 | | 11/2001 | Hoffman | 248/682 |

FOREIGN PATENT DOCUMENTS

| | | |
|---|---|---|
| EP | 93114960.3 | 9/1993 |
| JP | 58034263 | 3/1983 |
| JP | 63221367 | 9/1988 |
| JP | 01288910 | 11/1989 |
| JP | 05299510 | 11/1993 |
| JP | 07164798 | 6/1995 |
| JP | 07283501 | 10/1995 |
| JP | 08025728 | 2/1996 |
| JP | 96139957 | 6/1996 |
| JP | 08280466 | 10/1996 |
| JP | 08280683 | 10/1996 |
| JP | 09077841 | 3/1997 |
| JP | 09156863 | 6/1997 |
| JP | 97263886 | 9/1997 |
| JP | 10091484 | 4/1998 |
| JP | 9963729 | 3/1999 |
| JP | 2000044804 | 2/2000 |
| WO | PCT/GB96/02142 | 9/1996 |

* cited by examiner

*Primary Examiner*—Ko-Hung Chan
*Assistant Examiner*—Ingrid Weinhold
(74) *Attorney, Agent, or Firm*—Squire, Sanders & Dempey L.L.P.

(57) ABSTRACT

A bracket assembly system is provided to hold side and center channel speakers. The assembly system may be positioned on a base support structure such as a television or cabinet. In a typical arrangement, left and right satellite speakers are positioned such that the center of gravity is approximately aligned with the pivot axis of the side arms. In addition, additional speakers may be positioned along the support arms and the speakers may be rotated adjusting to desired speaker angles to accommodate for various room acoustics.

31 Claims, 4 Drawing Sheets

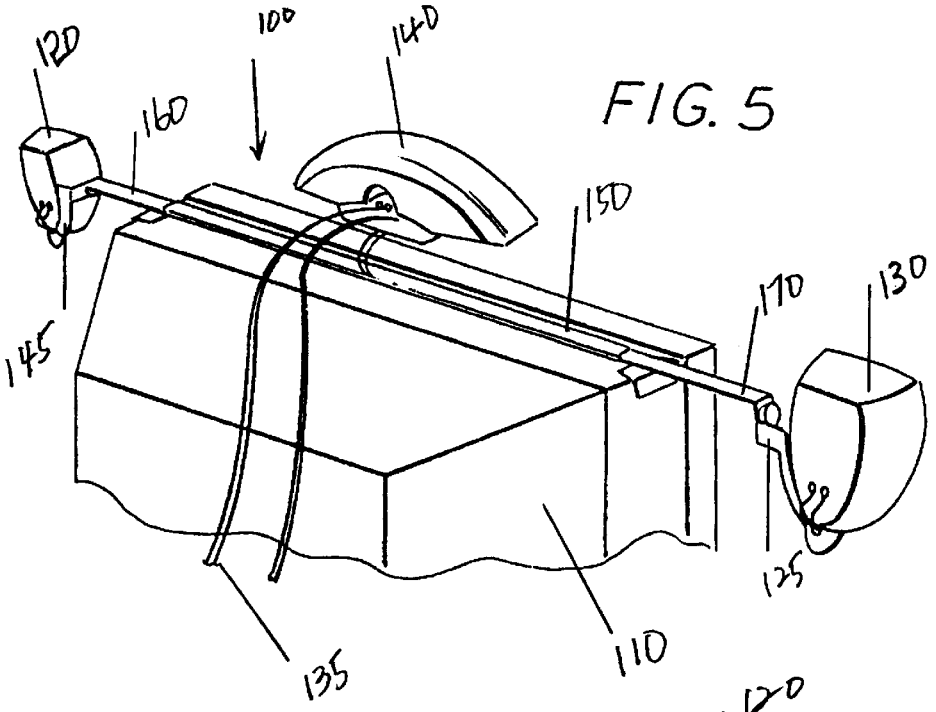
FIG. 5
FIG. 6
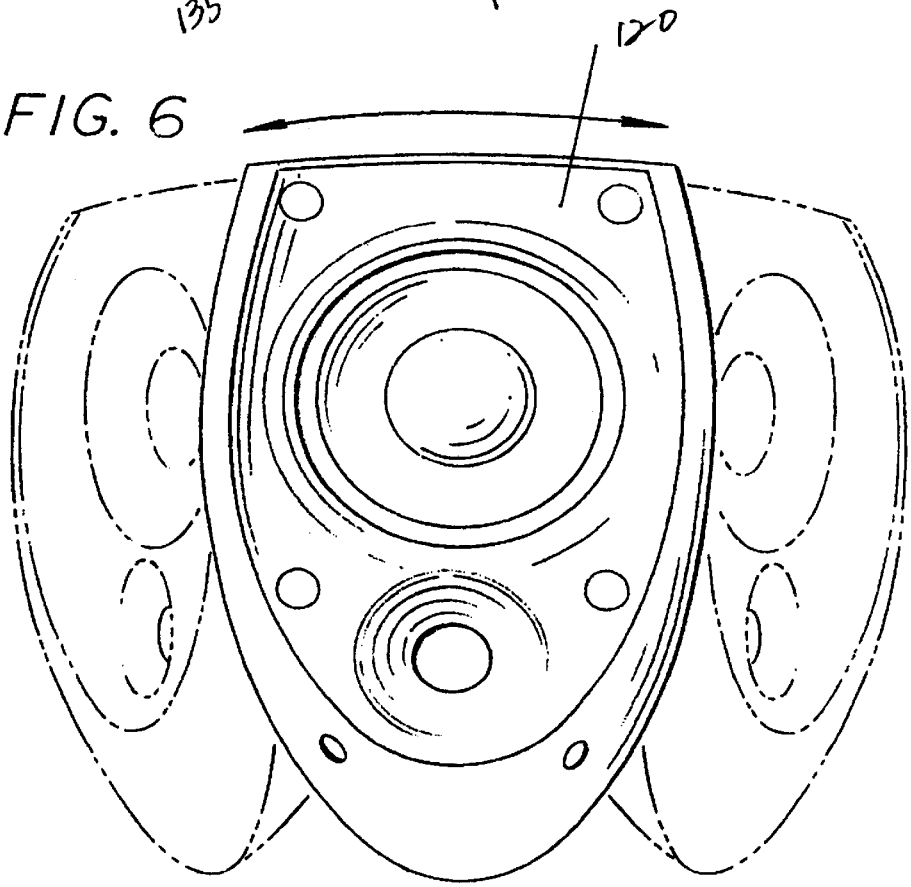

CROSSBAR BRACKET ASSEMBLY FOR SPEAKERS AND MONITORS

CROSS-REFERENCE TO RELATED APPLICATION

This non-provisional application claims priority to a Provisional Application Ser. No. 60/302,830 field Jul. 2, 2001.

BACKGROUND OF THE INVENTION

1. Field of the Invention

This invention relates generally to a bracket assembly adapted to support at least two satellite speakers and an optional center speaker over a base member. The use of screws on the base member may be eliminated and allows an easy adjustment of the satellite speaker angles.

2. Related Art

In a surround sound system, the positions and angles of different speakers determine the overall efficiency of the sound system. Depending on the shape, size and location of a particular surround environment, the speakers are positioned and arranged in a particular fashion to achieve the desired overall sound effect. With the conventional surround sound systems, speakers are often placed on a bookshelf or speaker stands or attached to a wall. Wiring and other physical attachment methodologies such as screws, clips, adhesives, etc. are often required to place multiple speakers in different locations in a room. In addition, once attached to a wall or otherwise positioned, it if often difficult to rearrange the speakers and adjust the angles of the speakers without incurring further physical maneuverings.

In a relative small size environment or for a family entertainment system, it may be acoustically desirable to have multiple speakers in a same plane so that a uniform soundstage between the speakers is achieved. For example, home entertainment systems may provide multiple speakers placed on top of a TV set or be attached to the sides of a TV set. These conventional systems, however, are often not capable of postponing and maintaining the speakers in a same plane and allowing adjustments of the angles to achieve the most efficient and desired sound effect.

Therefore, there is a need for a system allowing for easy installation and angle adjustment of the speakers of the surround sound system where the speakers can be secured on the top of a TV set.

SUMMARY

This invention provides a system to position and secure at least two satellite side speakers and/or an optional center speaker on a bracket assembly adapted to mount on top of a TV set or any other support structure. The bracket mounting assembly includes a center strut and a left and a right struts. The left and right strut may be slidably coupled to the center strut. The assembly further includes at least a left and right speakers pivotally coupled to the left and right struts respectively. The struts may also support additional speakers attached to the strut.

The invention also provides a support mechanism of the strut. The strut may be supported by the base member, by a TV set or other support structure. This may be accomplished without using screws or other physical attachments. The left and right struts may slide with respect to the center strut providing adjustment between the speakers. The width between the left and right struts may be wider than the predetermined width of the base member so that each of the left and right struts extends out along the side of the base member. To hold the bracket assembly in its place, the weight of the two satellite speakers along the opposite sides of the base member may be used to hold the bracket assembly relative to the base member.

This invention also provides an adjustment mechanism for the left and right satellite speakers relative to its respective speaker arms. This may provide a minimization of tipping over and a mechanism to hold the bracket assembly down. The center of gravity of each of the satellite speakers may be aligned with the pivot axis of each of the left and right speaker arms respectively. This alignment enables the satellite speakers to be held within the respective speaker arm and allows the satellite speakers to rotate without tipping over.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

FIG. 5 is a perspective rear view of the bracket assembly.

FIG. 6 is a front view of a satellite speaker illustrating degree of rotation of the speaker.

DETAILED DESCRIPTION OF THE PREFERRED EMBODIMENTS

Figure 1:
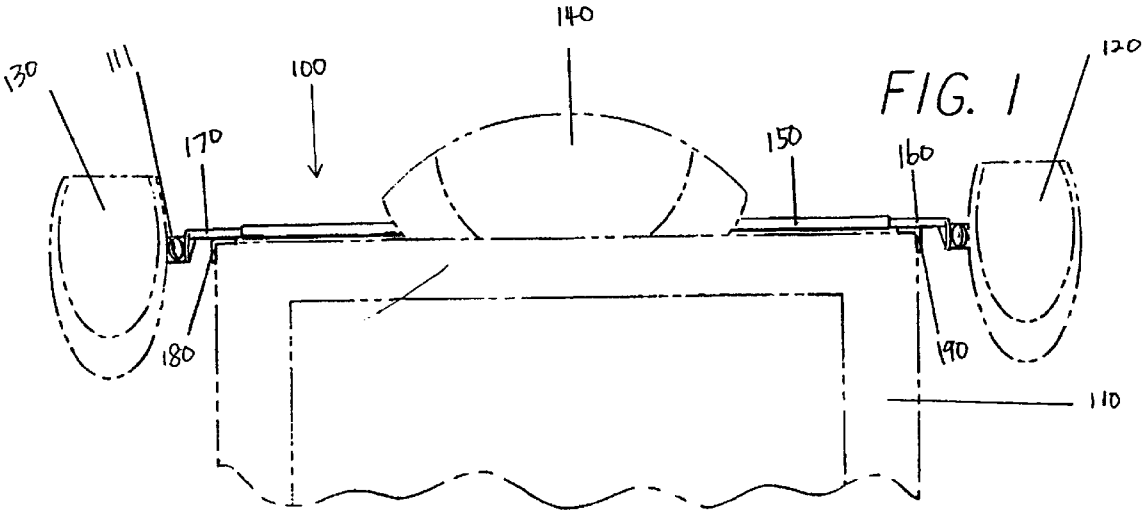
FIG. 1 is a front view of a bracket assembly illustrating two satellite speakers and an optional center speaker held on top of a base member.

FIG. 1 illustrates a bracket assembly 100 positioned over a base member 110. The base member 110 has a predetermined width and may vary in its shape. Examples of base members 110 may be a television set, entertainment box, cabinet, monitor, etc. The bracket assembly 100 includes a center strut 150 adapted to couple to a center speaker 140. A right side strut 160 may be slidably coupled to the right side of the center strut 150. A first support pad (not shown) may be coupled to the bottom side of the right side strut 160, between the right side strut 160 and the base member 110, to support the right side strut 160 on top of the base member 110. A right corner bracket 190 may be also coupled to the bottom side of the right side strut 160 at a predetermined position. To minimize the side-to-side movement of the bracket assembly 100 on top of the base member 110, the right side strut 160 may be inserted into the center strut 150 until the right corner bracket 190 is flush against the right side of the base member.

On the left side of the bracket assembly 100, a left side strut 170 may be slidably coupled to the left open end of the center strut 160. Like the right side strut 160, a second support pad (not shown) and a left corner bracket 180 may be coupled to the left side strut 170. Again, to hold the bracket assembly 100 in place, both the right and left side struts may be inserted into the center strut 150 until the right and left corner brackets 190, 180 are flush against the left and right sides of the base member 110. A left speaker arm and right side arm (not shown in FIG. 1) may be pivotally coupled to the left side strut 170 and the right side strut 160, respectively, to hold a left satellite speaker 130 and a right satellite speaker 120. Additional speakers (not shown) may also be shown attached to the struts 160 and 170. Such an arrangement may be used in a 7.1 or greater speaker system where multiple left and right speakers may be positioned to further enhance the sound listening environment.

The first and second support pads (not shown) help distribute the weight of the bracket assembly 100 across the top of the base member 110. The left and the right corner brackets 180, 190 may be shaped like a "L" to snugly or firmly hold the sides of the base member 110. To securely couple the center strut 150 to the two side struts 160, 170, the center strut 150 may have a first and a second securing holes (not shown) each adapted to receive a securing pin (not shown) to prevent the left and right side struts 170, 160 from sliding once coupled to the center strut 150. Alternatively, friction or adhesives may be used between the center strut and the two side struts to hold the two struts in place.

The bracket assembly 100 may be placed on top of the base member 110. This placement may be accomplished without using any screws or other attachment mechanisms. Other attachment mechanisms may be used to secure the bracket member 100 to the base member if desired. However, this invention minimizes the need of an attachment mechanism such as screws or adhesives and instead uses the weight of the speakers 130 and 120 to hold the bracket assembly 100 in place on top of the base member 110. To balance the weight of the satellite speakers 130 and 120, the center strut 150 may be placed along the center of the base member 110. The two side struts 170 and 160 may extend from the center strut 150. In addition, the weight of the center speaker 140 may be used as well to secure the center strut 150 on top of the base member 110. With the bracket assembly 100, the two satellite speakers and the center speaker may be located near the TV in the same vertical and horizontal planes to substantially provide a uniform soundstage for the front speakers, (typically the left, right and center speakers). As such, the bracket assembly 100 provides a platform for the speakers to generate acoustically ideal surround sound system.

Figure 2:
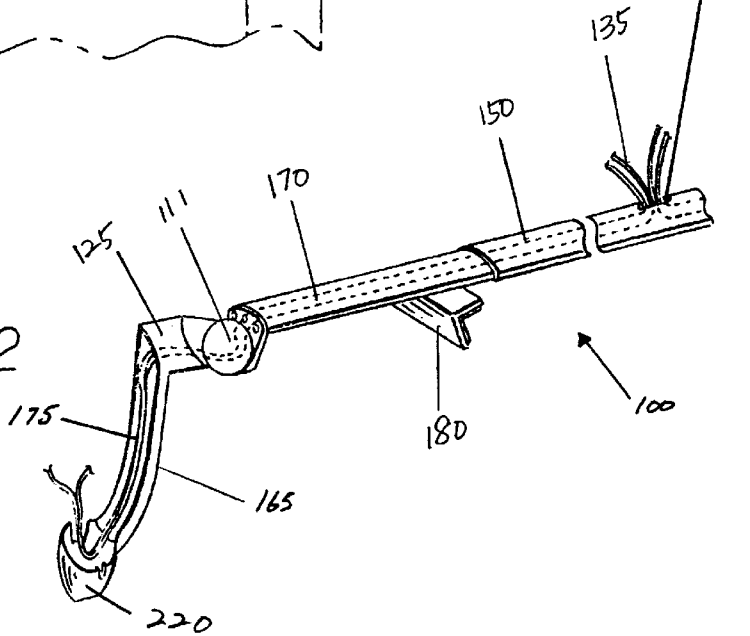
FIG. 2 is a perspective view of a left portion of the bracket assembly in FIG. 1 illustrating a left strut extending from a center strut and a left speaker arm pivotally coupled to the left strut.

FIG. 2 illustrates the speaker arms 125 pivotally coupled to the left strut 170, that in turn may be slidably coupled to the center strut 150. The left speaker arm 125 may pivot about a pivot point 111 on the left side strut 170. A securing mechanism such as a pin or screw may be used to provide the pivot action between the left speaker arm 125 and the left strut 170. The left speaker arm 125 may also have a cup 220 capable of receiving at least one of the left speakers. In particular, electrical wires 135 to the speaker may be hidden by running the wires 135 through the bottom side of the bracket assembly 100 and out the speaker wire access hole 155 located in the center strut 150. The left speaker arm 125 may have an elbow 165 with a recess 175 to dispose the wires within the recess to further hide the wires 135 from the front view.

FIG. 2 also illustrates the left corner bracket 180 coupled along the bottom of the left side strut 170. The left corner bracket 180 may rotate relative to the left strut 170 so that if the left side of the base member is oblique then the left corner bracket 180 may adjust to account for the oblique side of the base member. The right side of the bracket assembly 100 is a mirror image of the left side illustrated in FIG. 2.

Figure 3:
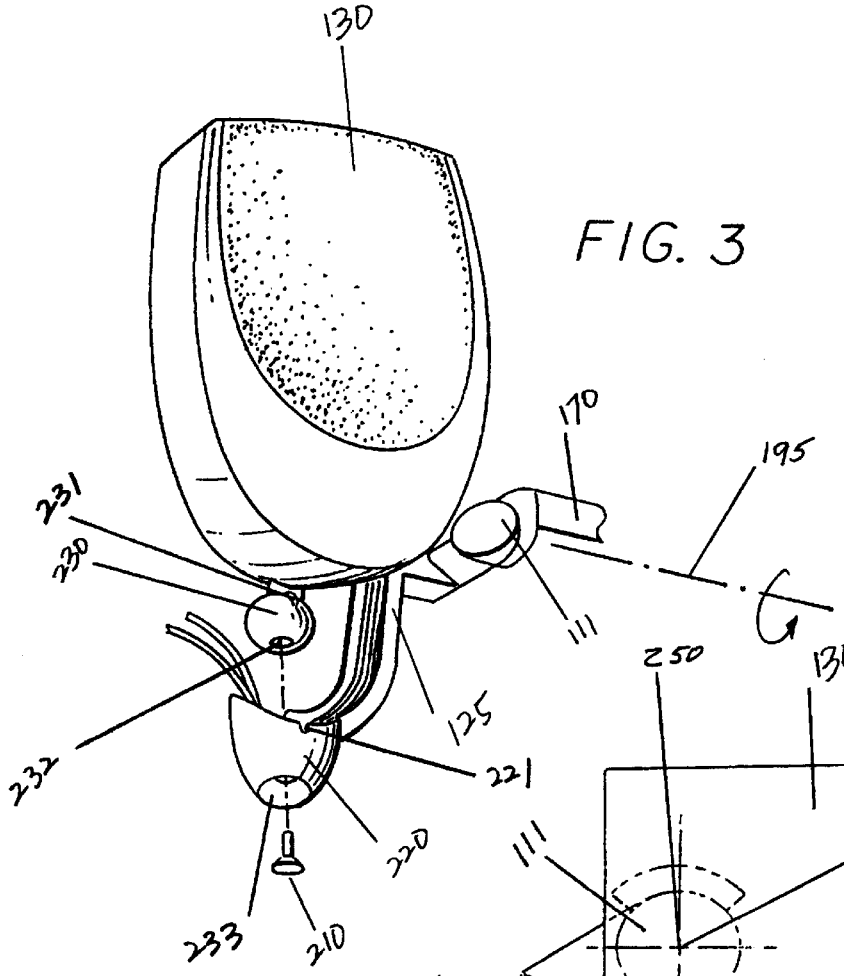
FIG. 3 is a perspective view of a satellite speaker coupled to the left speaker arm of FIG. 2.

FIG. 3 is a perspective view of the left satellite speaker 130 adapted to couple to the left speaker arm 125. The left speaker arm 125 may have a cup 220 adapted to receive a mounting ball 230 protruding from the left satellite speaker 130. The mounting ball 230 may have a threaded opening 232 on the bottom side and a flange 231 on the upper side. The mounting ball 230 may be shaped to fit into the cup 220, and the flange 231 on the mounting ball is adapted to fit into a notch 221 on the cup 220. Fitting the flange 231 into the notch 221 acts to ensure that the speaker 130 is properly aligned with the bracket assembly 100. To tie down the speaker 130 to the left speaker arm 125, a screw 210 may be inserted into the threaded opening 232 through a hole 233 located at the bottom of the cup 220. Likewise, the right satellite speaker may be coupled to the right speaker arm in a similar manner and additional speakers may be mounted to the speaker arm (not shown). This may be accomplished by attaching the additional speakers to an attachment mechanism secured to the speaker arm allowing the speaker arm to be adjusted. The attachment mechanism may also allow the speaker to be laterally moved and positioned along the speaker arm as well as pivotally rotated or aimed by moving the speaker such that the mounting ball moves within the cup.

FIG. 3 also shows the left speaker arm 125 pivotally coupled to the left side strut 170 about the left pivoting point 111. That is, the left side speaker arm 125 may rotate about the longitudinal axis 195 that is substantially parallel to the left side strut 170, which in turn allows the speaker 130 to rotate as well. This allows further flexibility to adjust the position and angle of the left satellite speaker 130 depending on the positioning of the bracket assembly. For instance, if the bracket assembly is above its optimum height level, then the speaker arm 125 may be rotated so that the speaker 130 faces down. Likewise, the right speaker arm 145 may pivot about the longitudinal axis 195 as well.

Figure 4:
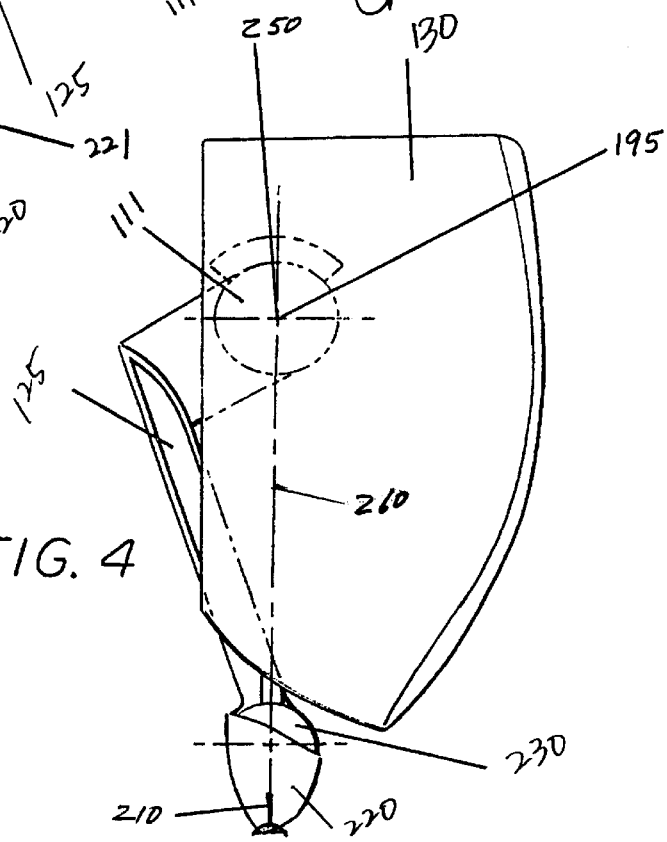
FIG. 4 is a side view of a satellite speaker having its center of gravity aligned with the pivot axis of the speaker arm in FIG. 2.

FIG. 4 is a side view of the left speaker arm 125 and the left satellite speaker 130. The speaker 130 may have a center of gravity 250 that is substantially aligned with the longitudinal axis 195. Put differently, the center of gravity 250 of the speaker 130 and the pivot point 111 are substantially aligned with respect to each other. As the speaker arm 125 is rotated about the pivot point 111, the center of gravity 250 remain substantially aligned with the pivot point 111 and the longitudinal axis 195 so that the weight of the speaker 130 is always applied vertically about the pivot pint 111. Rotating the speaker arm 125 typically does not affect the weight of the speaker 130 being applied to the bracket assembly and does not apply a torque load to the bracket assembly to tip the bracket assembly over from the base member. The speakers may be angled differently yet still maintain the symmetry in which the weight of the speakers are being applied to the bracket assembly.

As illustrated in FIG. 4, the speaker arm 125 may be positioned so that the line 260 between the center of gravity 250 of the speaker 130 and the cup 220 is substantially vertical in the direction of gravity. In this position, the weight of the speaker 130 does not apply any torque load on the screw 210 used to couple the mounting ball 230 to the cup 220. Alternatively, just the weight of the speaker 130 and the flange 231 fitted into the notch 221 may be used to hold the mounting ball 230 within the cup 220 without using additional securing mechanisms such as screws 210. The flange 231 fitted into the notch 221 prevents the speaker 130 from moving side-to-side and tilting forward, and the weight of the speaker 130 may provide sufficient friction between the mounting ball 230 and the cup 220 to hold the speaker 130 within the cup 220.

FIG. 5 shows a rear view of the bracket assembly 100 with two satellite speakers 120, 130 and the center speaker 140 mounted on the base member 110. To provide electrical signals to the speakers, the speaker wires 135 may run along the bottom and rear sides of the bracket assembly so that the wires 135 are hidden from the front view. The center speaker 140 may be coupled to the center strut 150 via a clip-on mechanism. That is, the center speaker 140 may be placed over the speaker wire access hole 155 (see FIG. 2), then lowering the center speaker 140 on to the center strut 150, and clipping the center speaker 140 on the center strut 150. FIG. 6 illustrates that a satellite speaker 120 may rotate from side-to-side relative to the mounting ball. That is, the satellite speakers 120, 130 may freely rotate and adjust to achieve the desired speaker angle and sound radiation output.

Figure 7:
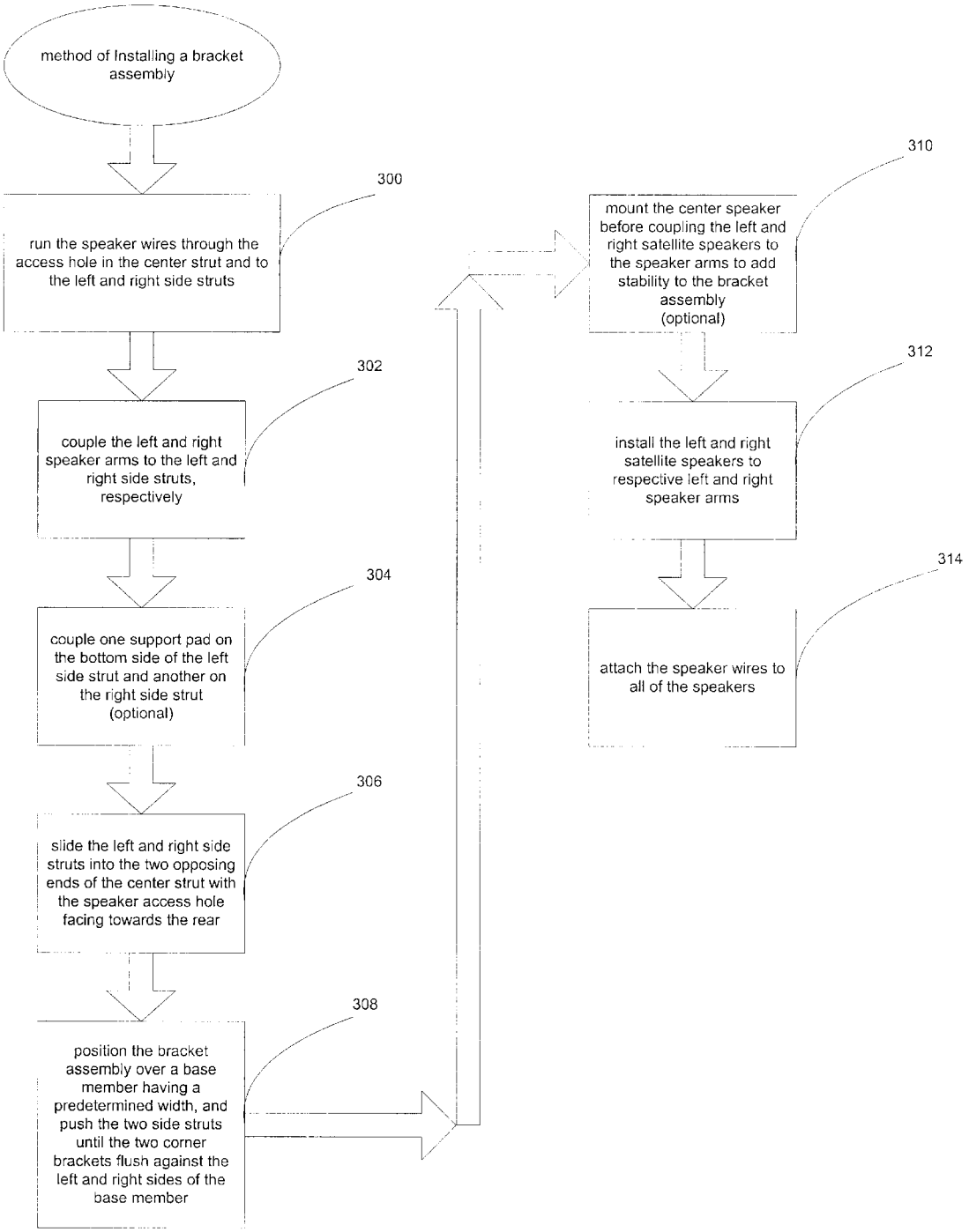
FIG. 7 is a flow chart for installing a bracket assembly over a base assembly.

FIG. 7 illustrates one of many methods of installing the bracket assembly onto a base member. In step 300, run the speaker wires through the access hole in the center strut and to the left and right side struts. In step 302, couple the left and right speaker arms to the left and right side struts, respectively. In step 304, as an option, couple one support pad on the bottom side of the left side strut and another on the right side strut. Couple one corner bracket on the bottom side of the left side strut and another on the right side strut. The two support pads need to be inside of the two corner brackets. In step 306, slide the left and right side struts into the two opposing ends of the center strut with the speaker access hole facing towards the rear. In step 308, position the bracket assembly over a base member having a predetermined width, and push the two side struts until the two corner brackets flush against the left and right sides of the base member. In step 310, as an option, mount the center speaker before coupling the left and right satellite speakers to the speaker arms to add stability to the bracket assembly. In step 312, install the left and right satellite speakers to respective left and right speaker arms. And in step 314, attach the speaker wires to all of the speakers.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A mounting assembly, comprising:

a left corner bracket capable of rotation, coupled to a bottom side of a left side strut where the left corner bracket is attached to a base member left side;

a right corner bracket capable of rotation, coupled to a bottom side of a right side strut where the right corner bracket is attached to a base member right side;

a center strut located between the left and right side struts where both the left and right side struts slidably couple to the center strut;

a left speaker arm pivotally coupled to the left side strut where the left speaker arm has a cup configured to couple to a mounting ball protruding from a left speaker; and a right speaker arm pivotally coupled to the right side strut where the right speaker arm has a cup configured to couple to a mounting ball protruding from a right speaker and the center strut and the left and right side struts adapted to be placed on top of the base member.

2. A speaker mounting assembly system, comprising:

a left speaker having a center of gravity;

a right speaker having a center of gravity;

a left side strut having a left corner bracket;

a right side strut having a right corner bracket;

a center strut located between the left and right side struts, the left and right side struts slidably coupled to the center strut to flush the left and right corner brackets against a left side and a right side of a base member respectively;

a left speaker arm coupled to the left side strut and adapted to receive a left speaker, where the left speaker arm pivots about a left pivot axis, the left speaker arm adapted to couple to the left speaker so that the center of gravity of the left speaker is substantially aligned with the pivoted axis; and a right speaker arm coupled to the right side strut and adapted to receive a right speaker, where the right speaker arm pivots about a right pivot axis, the right speaker arm adapted to couple to the right speaker so that the center of gravity of the right speaker is substantially aligned with the right pivoted axis.

3. The mounting assembly of claim 2, wherein the left and right speaker arms are pivotally coupled to the left and right side struts respectively.

4. The mounting assembly of claim 3, wherein the left and right satellite speakers have substantially similar weight, and the weight of the left and right satellite speakers are substantially symmetrically apart from the center strut.

5. The mounting assembly of claim 3, wherein the center strut further comprises a speaker wire access hole adapted to receive wires for the left and right satellite speakers.

6. The mounting assembly of claim 3, wherein each of the speakers includes a mounting ball having a flange and a threaded opening, the mounting ball adapted to fit into the cup of the speaker arm and the flange adapted to fit into the notch.

7. The mounting assembly of claim 6, further comprising a screw adapted to insert through a hole at a bottom of the cup and into the threaded opening of the mounting ball.

8. The mounting assembly of claim 2, further including a center speaker adapted to couple to the center strut via a clip-on mechanism.

9. The mounting assembly of claim 2, wherein the left and right speaker arms each includes a receiving notch and a cup adapted to receive a flange formed on a mounting ball extending from the left and right satellite speakers respectively.

10. The mounting assembly of claim 9, wherein the first left and second right corner brackets are slidable along a longitudinal axis of the center strut, and firmly hold the sides of the base member located between the left and right corner brackets.

11. The mounting assembly of claim 9, wherein the first left and second right corner brackets are L shaped.

12. The mounting assembly of claim 2, wherein the center strut further includes a first securing hole and a second securing hole, each securing hole adapted to receive a securing pin to prevent the left and right side struts from moving.

13. The mounting assembly of claim 2, wherein the base member is a television set.

14. A mounting assembly for mounting a plurality of speakers over a supporting base member, comprising:

a first strut located between a second strut and a third strut;

a first speaker pivotally coupled to the second strut;

a second speaker pivotally coupled to the third strut; and a holding mechanism attaching the first, second and third strut to a base member, where the first and second speakers pivot about a pivot axis, where the first and second speakers each has a center of gravity that are substantially aligned with the pivot axis.

15. The mounting assembly according to claim 14, comprising a third speaker connected to the first strut.

16. A mounting assembly for mounting two speakers over a supporting base member, comprising:

a center strut located between a left side strut and a right side strut;

means for pivotally coupling a left speaker to the left side strut;

means for pivotally coupling a right speaker to the right side strut;

means for holding the center strut and the left and right side struts on top of a base member; and means for coupling a center speaker to the center strut.

17. The mounting assembly of claim 16, further comprising means for running electrical wires to the left and right speakers through an access hole on the center strut.

18. The mounting assembly of claim 16, further comprising means for evenly distributing the weight of the assembly and the left and right speakers over the base member.

19. The mounting assembly of claim 16, wherein the means for holding includes a left corner bracket and a right corner bracket coupled to the left side strut and the right side strut respectively, where the left and right side struts are inserted into the center bracket strut until the left and right corner brackets are flush against the left and right sides of the base member to hold the assembly to the base member.

20. A method for mounting a bracket assembly onto a base member, comprising:

coupling a left speaker arm to a left side strut, the left side strut having a left corner bracket;

coupling a right speaker arm to a right side strut, the right side strut having a right corner bracket;

sliding the left and right side struts into a left open end and a right open end of a center strut, respectively;

positioning the center strut and the left and right side struts over a base member having a predetermined width, the center strut having a longitudinal axis;

adjusting the left and right side struts until the left and right corner brackets flush against the base member having the predetermined width;

placing a left speaker into the left speaker arm, the left satellite speaker having a center of gravity; and placing a right speaker into the right speaker arm, the right speaker having a center of gravity, where the center of gravity of the left and right speakers are adapted to align with the pivot point of the left and right side struts respectively.

21. The method of claim 20, further comprising pivoting the left and right arms about a pivot point on each of the left and right side struts respectively.

22. The method of claim 20, further comprising:

installing a left speaker and a right speaker to the left and right speaker arms respectively; and balancing weight of the left and right speakers to hold the bracket assembly over the base member.

23. The method of claim 20, further comprising installing a center speaker to the center strut using a clip-on mechanism.

24. The method of claim 20, further comprising wiring electrical wires to the left and right speakers through the center strut and the left and right side struts.

25. A mounting assembly, comprising:

a center strut having a left open end and a right open end, the center strut having a longitudinal axis;

a left side strut adapted to slidably couple to the left open end of the center strut along the longitudinal axis;

a right side strut adapted to slidably couple to the right open end of the center strut along the longitudinal axis;

a left speaker arm adapted to pivotally couple to the left side strut along a left pivot axis, the left speaker arm adapted to support a left satellite speaker; and a right speaker arm adapted to pivotally couple to the right side strut along a right pivot axis, the right speaker arm adapted to support a right satellite speaker, where the left speaker has a center of gravity that is aligned with the left pivot axis, and the right speaker has a center of gravity that is aligned with the right pivot axis.

26. A speaker mounting system, comprising:

a left speaker having a center of gravity;

a right speaker having a center of gravity;

a center strut between a left strut and a right strut along a longitudinal axis, where the center strut is slidably coupled to the left and right struts along the longitudinal axis;

a left speaker arm coupled to the left strut along a left axis, where the left speaker arm supports the left speaker, where the center of gravity of the left speaker is substantially aligned with the left axis; and a right speaker arm coupled to the right strut along a right axis, where the right speaker arm supports the right speaker, where the center of gravity of the right speaker is substantially aligned with the left axis.

27. The system according to claim 26, where the left arm is pivotally coupled to the left strut along the left axis, and the right arm is pivotally coupled to the right strut along the right axis.

28. The system according to claim 26, where the left axis is aligned with the right axis.

29. The system according to claim 26, further including a left corner bracket and a right corner bracket, where the left corner bracket is coupled to a bottom side of the left strut, and the right corner bracket is coupled to a bottom side of the right strut, where the left and right corner brackets are adapted to associate with left and right sides of a base member, respectively.

30. The system according to claims 26, where the left and right speaker arms each includes a receiving notch and a cup adapted to receive a flange formed on a mounting ball extending from the left and right speakers, respectively.

31. The system according to claim 26, including a center speaker coupled to the center strut over a television.

* * * * *